United States Patent [19]

Krafft

[11] Patent Number: 4,709,542

[45] Date of Patent: Dec. 1, 1987

[54] METHOD AND APPARATUS FOR TWISTING FILAMENTS TO FORM A CABLE

[75] Inventor: Frederic B. Krafft, Holden, Mass.

[73] Assignee: The Entwistle Company, Hudson, Mass.

[21] Appl. No.: 855,112

[22] Filed: Apr. 22, 1986

[51] Int. Cl.[4] ..... D07B 3/04; D07B 3/00; D07B 3/12

[52] U.S. Cl. ..... 57/16; 57/13; 57/17; 57/58.32; 57/58.34; 57/59; 57/67; 57/314

[58] Field of Search ..... 57/16–18, 57/62, 67, 71, 314, 59, 13, 14, 60, 58.3–58.38; 242/25 R

[56] References Cited

U.S. PATENT DOCUMENTS

| | | | |
|---|---|---|---|
| 1,579,709 | 4/1926 | Janicki | 57/17 |
| 1,734,704 | 11/1929 | Yancey | 57/17 X |
| 1,843,075 | 1/1932 | Angell | 57/17 |
| 1,847,453 | 3/1932 | Webb | 57/17 |
| 2,200,955 | 5/1940 | Keating | 57/17 |
| 2,338,848 | 1/1944 | Henning et al. | 57/71 |
| 2,353,432 | 7/1944 | Arrington | 57/17 |
| 2,365,277 | 12/1944 | Keating | 57/17 |
| 2,365,661 | 12/1944 | Winslow | 57/17 |
| 2,567,329 | 9/1951 | Frazier | 57/58.34 X |
| 2,602,281 | 7/1952 | Bunch | 57/17 X |
| 2,717,485 | 9/1955 | Pearce | 57/58.32 |
| 2,782,138 | 2/1957 | Olson et al. | 57/17 X |
| 2,817,948 | 12/1957 | Cook | 57/71 X |
| 2,920,437 | 1/1960 | Stark | 57/17 |
| 2,929,193 | 3/1960 | Cook | 57/67 |
| 3,000,169 | 9/1961 | Richaud | 57/58.34 |
| 3,077,068 | 2/1963 | Miller | 57/13 X |
| 3,115,742 | 12/1963 | Ege | 57/59 X |
| 3,142,952 | 8/1964 | Krafft et al. | 57/58.32 |
| 3,286,451 | 11/1966 | Woolman | 57/58.32 |
| 3,955,348 | 5/1976 | Orlandi | 57/58.32 X |

*Primary Examiner*—John Petrakes
*Attorney, Agent, or Firm*—Salter & Michaelson

[57] ABSTRACT

A method and apparatus for making a twisted cable of unlimited length. The apparatus which is operative for performing the method includes a rotating reel having a group of wires or filaments wound thereon, a flyer which rotates around the reel for unwinding the group of wires or filaments therefrom, and a gathering assembly rotating with the flyer for gathering the individual filaments or wires from the group and twisting them to form a cable. The apparatus further includes a take-up assembly for drawing the cable from the gathering assembly and winding it on a take-up reel, and a control assembly for controlling the rotational speed of the flyer relative to the rotational speed of the reel to achieve a substantially uniform length of twist in the cable throughout its extent. After the original group of filaments or wires has been unwound from the reel, it is possible to wind a second group of filaments or wires onto the reel and to individually connect or weld the filaments or wires in the second group to those in the first group so that the different welds are located in longitudinally spaced positions. Thereafter, the second group of filaments or wires can be twisted to form a cable of extended length.

21 Claims, 7 Drawing Figures

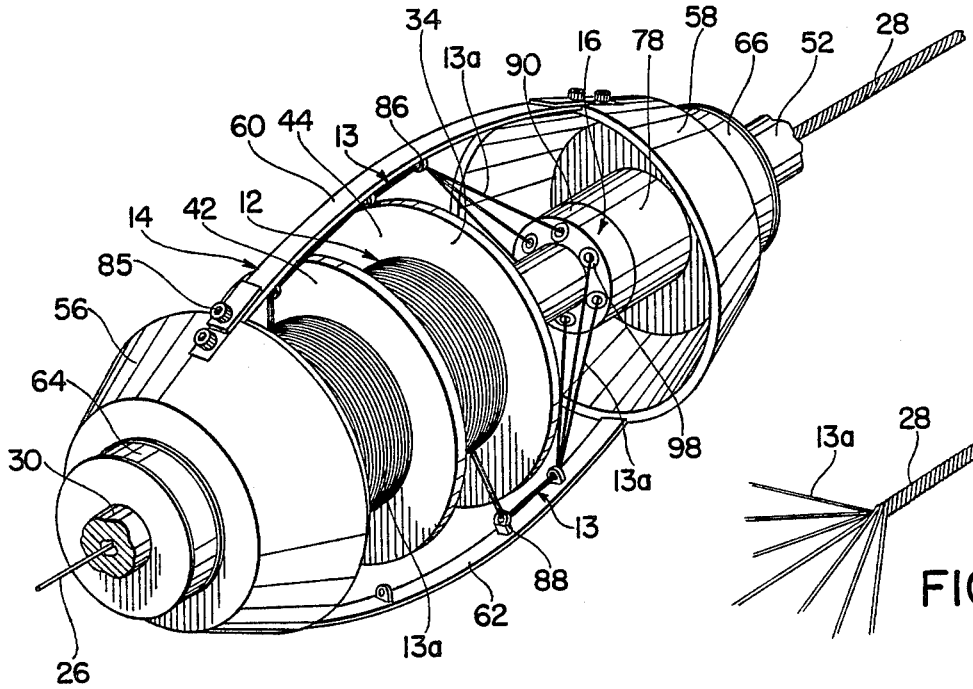
FIG. 5
FIG. 7
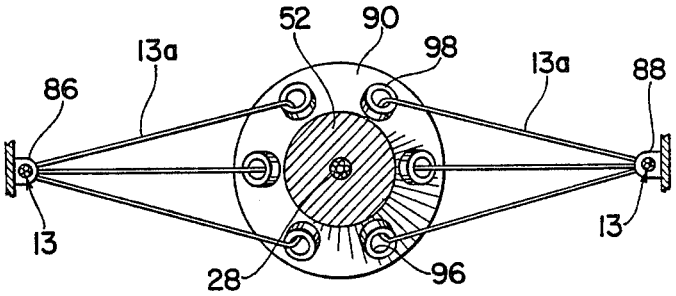
FIG. 6

METHOD AND APPARATUS FOR TWISTING FILAMENTS TO FORM A CABLE

BACKGROUND AND SUMMARY OF THE INVENTION

The instant invention relates to apparatus of the type used for stranding wires or filaments and more particularly to an apparatus and method for twisting wires or filaments to form a cable of unlimited length.

It is well recognized that flexible cables of the type comprising a plurality of wire elements which are twisted into a cable are highly effective for many electrical conductor and cable applications. For this reason, various types of apparatus have been developed over the years for twisting elements to form stranded cables. In this regard, one of the most common types of heretofore available machines of this general type is disclosed in the U.S. Pat. No. 2,817,948 to COOK. The device disclosed in this patent operates by feeding a plurality of wires to a rotating closing die where they are twisted around a core wire to form a cable. The cable is then passed to a rotating flyer which is also mounted in coaxial relation to the closing die so that it travels around a rotating reel which is mounted in coaxial relation to the closing die. The cable then passes from the flyer to the reel, and it is wound on the reel at a rate which is determined by the difference between the rate of rotation of the flyer and the rate of rotation of the reel. Actually, the difference between the rate of rotation of the flyer and the rate of rotation of the reel also controls the rate at which stranded cable is produced from the apparatus, since it controls the rate at which cable is drawn through the closing die. Further, since the closing die and the flyer rotate together, the difference between the rate of rotation of the flyer and the rate of rotation of the reel actually also controls the length of twist in the finished cable. For example, if cable is drawn through the closing die at an increased rate without increasing the rate of rotation of the flyer and the closing die, the length of each twist in the finished cable is increased correspondingly. However, since the rate at which cable is drawn through the closing die is also dependent on the winding diameter of the reel which varies as cable is wound thereon, conventional machines of this type have generally included a control apparatus for controlling the difference between the speed of the flyer and the speed of the reel to maintain a constant length of twist in the finished cable. An early control apparatus of this general type is disclosed in the U.S. Pat. No. 2,929,193 to COOK, and a more sophisticated digital electronic control device of this general type is currently manufactured and marketed by Cook Machinery Division of the Entwistle Company, of Hudson, Mass., as the "Cook Acculay Digital Lay Control System".

While wire twisting machines of the above described type have been effectively utilized for many years to form stranded cables at relatively high production rates, it has not been possible to form stranded cables of infinite lengths with machines of this type. This is because the maximum length of a cable which can be produced from a machine of this type is dictated by the size of the take-up reel or spool on which the finished product is wound. In this connection, since a machine of this type operates with a flyer which rotates around a take-up reel, it is not possible to replace or refill the take-up reel without completely removing and disconnecting the finished reel and the cable from the machine. Further, since it is not considered to be acceptable practice to weld two cables together by welding the individual strands thereof together unless the individual welds are spaced at different points along the extent of the composite cable, it has generally not been practical or even possible to weld two stranded cables together to form a single high-quality cable of increased length with a machine of this type.

The instant invention provides an effective method and apparatus which can be operated at high speeds for producing cables of infinite lengths. Specifically, in its preferred embodiment, the apparatus of the instant invention is operative for twisting a wire element or a filament on an advancing core, and it comprises a reel mounted for rotation about an axis and having a wire element wound thereon, a flyer mounted for rotation about the axis so that it travels around the reel and engages the wire element for unwinding it from the reel, means for rotating the reel about its axis, and means for rotating the flyer about its axis in the same direction as the reel but at a speed which causes the wire element to be unwound from the reel by the flyer. The apparatus further comprises gathering means rotating about the axis of the reel with the flyer for gathering the wire element therefrom and for twisting it around the core element as the core element is passed axially through the gathering means to form a cable. In addition, the apparatus comprises means for drawing the cable from the gathering means, means for measuring the number of rotations of the flyer and the gathering means per unit length of cable, and means for controlling and adjusting the rotational speed of the flyer relative to the rotational speed of the reel to achieve a substantially uniform number of rotations of the reel per unit length of cable so that the cable has a substantially uniform length of twist. Accordingly, during operation of the apparatus in accordance with the method, a wire element is unwound from the reel and wound onto the core as the core and the wire element pass through the gathering means, and the means for controlling and adjusting the rotational speed of the flyer relative to the rotational speed of the reel operates to achieve a substantially uniform length of twist in the cable even though the winding diameter of the reel is gradually reduced as the wire element is unwound therefrom. The apparatus is preferably constructed so that it is operative for simultaneously twisting a plurality of groups of wires onto a central core wire. Accordingly, the apparatus preferably includes first and second reels which are rotatably mounted about a common axis and which have first and second groups of side-by-side wires, respectively, wound thereon. The apparatus preferably further comprises first and second flyers which are mounted for rotation around the reels for unwinding the first and second groups of wires, respectively, therefrom and the gathering means is preferably operative for aligning different wires of the different groups in different spaced positions around the core wire and for twisting them around the core wire to form a cable. The first and second flyers are preferably disposed in substantially opposite radial positions relative to the axis of the reels, and the gathering means is preferably operative for aligning the wires from the first group in spaced relation on the same side of the axis as the first flyer and for aligning the wires from the second group in spaced relation on the same side of the axis as the second flyer. The apparatus is preferably constructed so that the flyer rotating means and the reel rotating means are independent of the means for drawing the cable from the gathering means, and the means for drawing the cable from the gathering means is preferably operative without significantly affecting the rotational speeds of the flyer and the reel. Further, the gathering means is preferably embodied as a closing die for twisting the wires around the core. In addition, the apparatus preferably also comprises means for determining the number of revolutions of the flyer relative to the reel in order to determine the amount of wire element left on the reel, and the means for rotating the reel is preferably reversible to enable it to be utilized for rewinding one or more additional wires thereon after it has been emptied. Still further, while the apparatus is normally operated for twisting filaments or wires around an advancing core wire or filament, it will be understood that it can also be operated for twisting two or more filaments or wires together to form a cable without a core wire or filament. Applications of this type are generally required to form cables having quantities of strands or filaments which do not readily lend themselves to normal symmetrical cable configurations, as is well known in the wire and cable industry.

Accordingly, during use and operation of the apparatus of the instant invention in accordance with the method of the instant invention, groups of wires are unwound from the reels by the flyers, and the wires are either twisted onto an advancing core wire or twisted together to form a stranded cable. In this connection, since the apparatus includes means for measuring the number of rotations of the flyer per unit length of cable and for controlling and adjusting the rotational speed of the flyer relative to the rotational speed of the reel to achieve a substantially uniform number of rotations of the flyer per unit length of cable, it is possible to make a cable having a uniform length of twist throughout its entire extent even though the wound diameters of the reels with the wires thereon are gradually reduced as the wires are unwound. Further, when all of the wires have been unwound from the reels, it is possible to wind new groups of wires onto the reels and to weld the ends of the new wires to the ends of the original wires so that the different welds in each group are located in longitudinally spaced locations. Accordingly, when the wires are twisted around the core wire or wound together, the welds are located in longitudinally spaced positions in the cable, and by joining the wires together in this manner, it is possible to construct a high-quality cable of unlimited length with the apparatus of the instant invention.

Devices representing the closest prior art to the instant invention of which the applicant is aware are disclosed in the U.S. Pat. Nos. 1,579,709 to Janicki; 1,734,704 Yancey, 2,200,955 2,365,277; Keating; 2,365,661 Winslow; 2,602,281 Bunch; 2,782,138 Olson et al; 3,077,068 Miller and 3,115,742 Ege. However, these references fail to suggest a wire twisting apparatus wherein wire is unwound from a reel by a flyer and then twisted to form a cable and wherein the speed of the flyer relative to the speed of the reel is controlled and adjusted to produce a cable having a substantially uniform length of twist. They also fail to suggest a wire twisting apparatus wherein groups of wires are unwound from several different reels or reel sections and then wound onto gathering means comprising a core wire with a closing die. They also fail to suggest a wire twisting apparatus comprising means for rotating the flyer and means for rotating the reel which are independent of the means for drawing cable from the gathering means and wherein the means for drawing cable from the gathering means operates without significantly affecting the rotational speeds of the flyer and/or the reel. Hence, for these reasons, the above references are believed to be of only general interest with respect to the instant invention.

Accordingly, it is a primary object of the instant invention to provide an effective wire twisting apparatus which is capable of producing twisted cables of unlimited lengths.

Another object of the instant invention is to provide an effective wire twisting apparatus which is operative for producing twisted cables of unlimited lengths having substantially uniform lengths of twist throughout their extents.

Another object of the instant invention is to provide an effective apparatus for producing twisted cables of unlimited lengths at high-production rates.

A still further object of the instant invention is to provide an effective method of forming a twisted cable of unlimited length.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 5 is a perspective view of the wire twisting portion;

FIG. 6 is a fragmentary sectional view taken along line 6—6 in FIG. 4; and FIG. 7 is a perspective view illustrating the manner in which the wires are twisted with the closing die and the lay plate.

DESCRIPTION OF THE INVENTION

Figure 1:
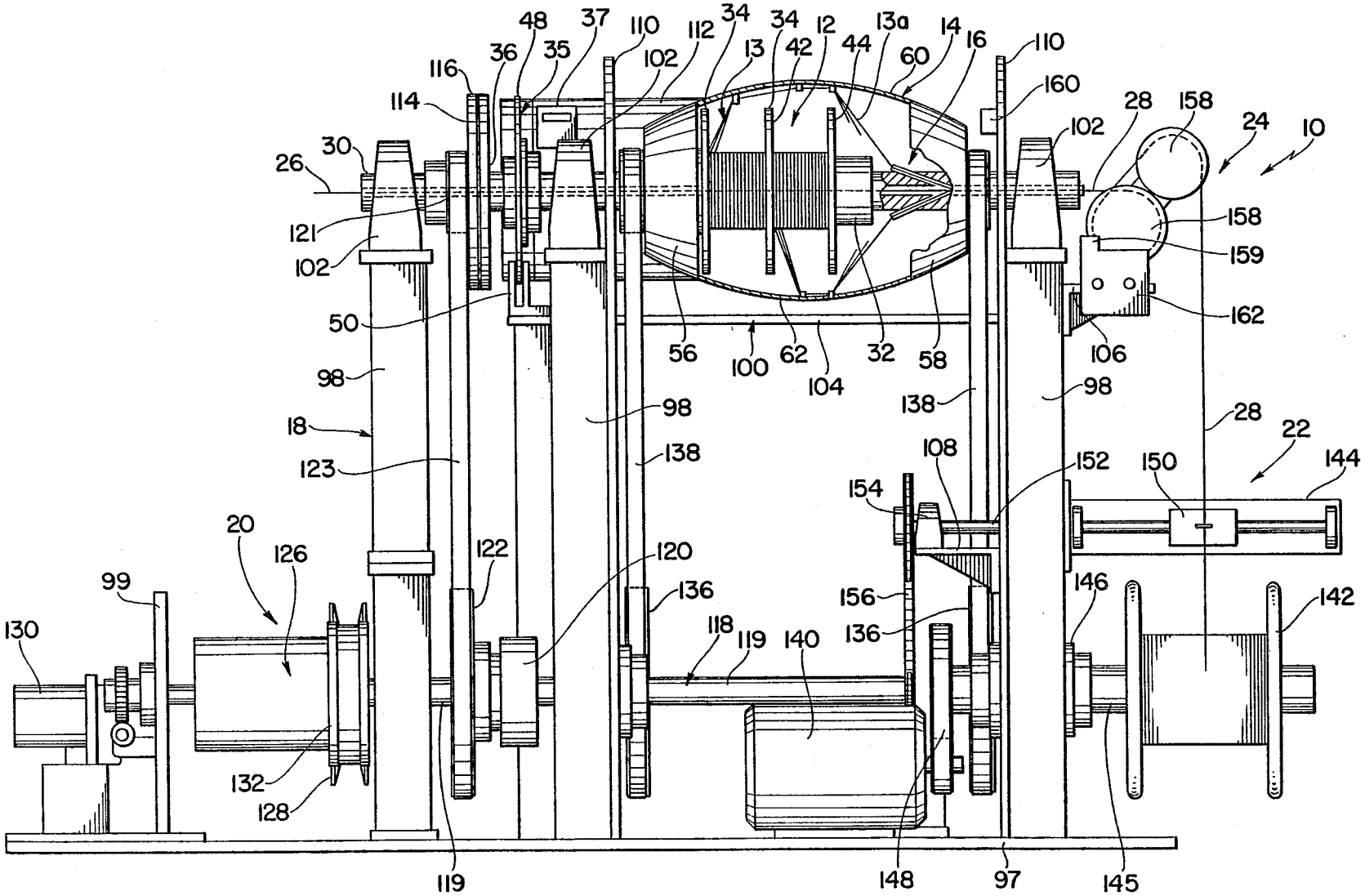
FIG. 1 is a side elevational view of the apparatus of the instant invention.
Figure 2:
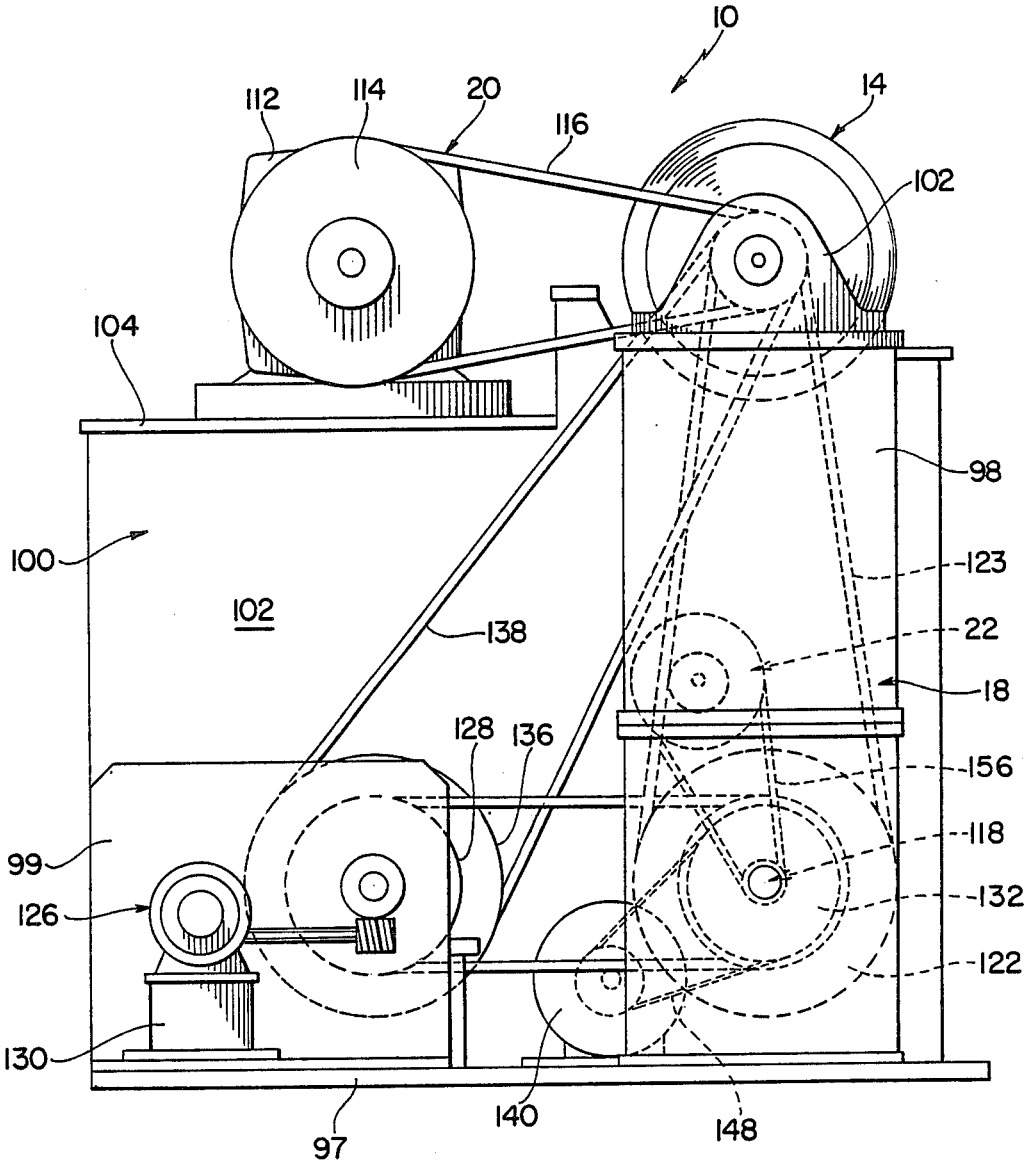
FIG. 2 is an end elevational view thereof.
Figure 3:
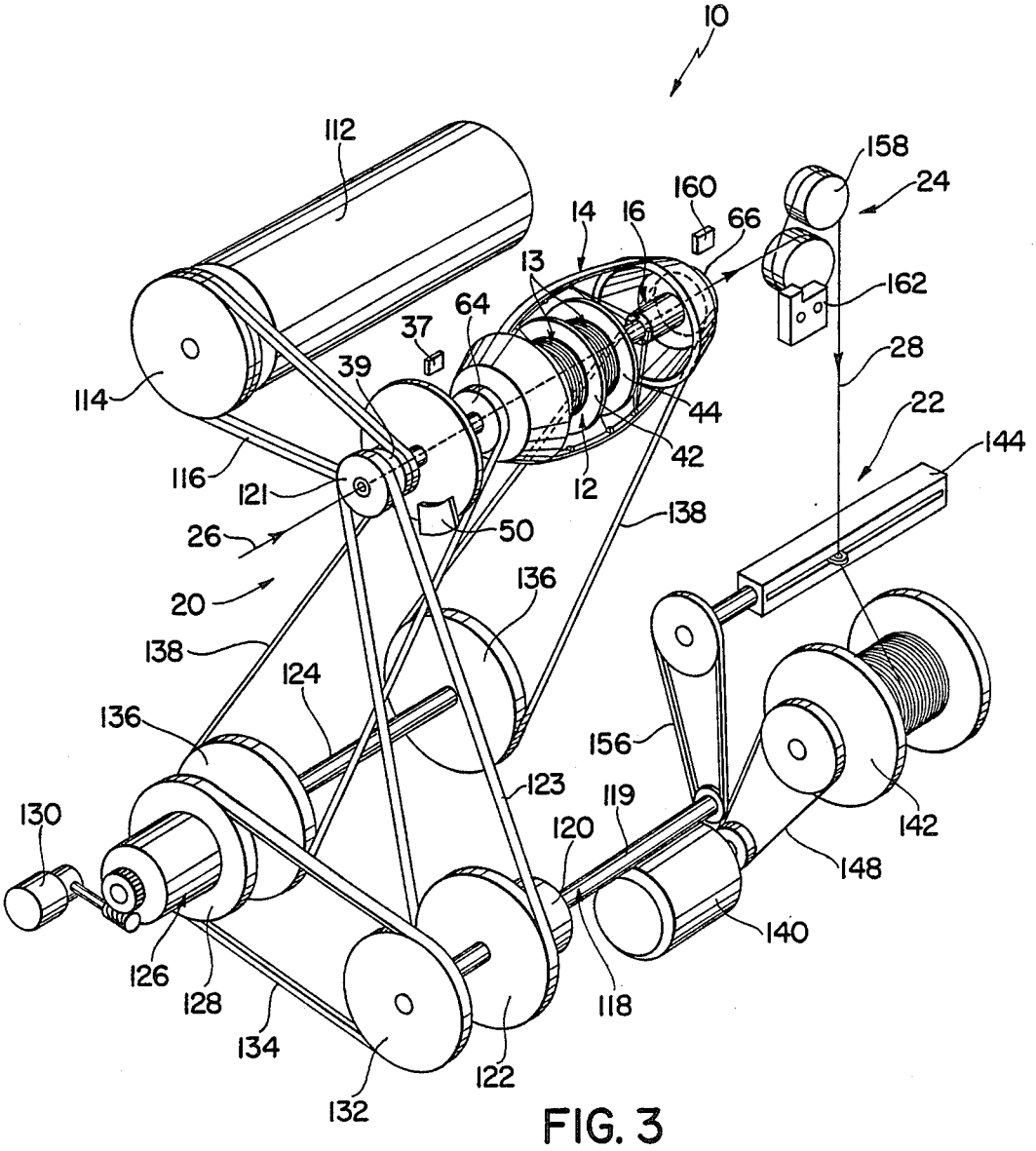
FIG. 3 is a schematic perspective view of the apparatus.
Figure 4:
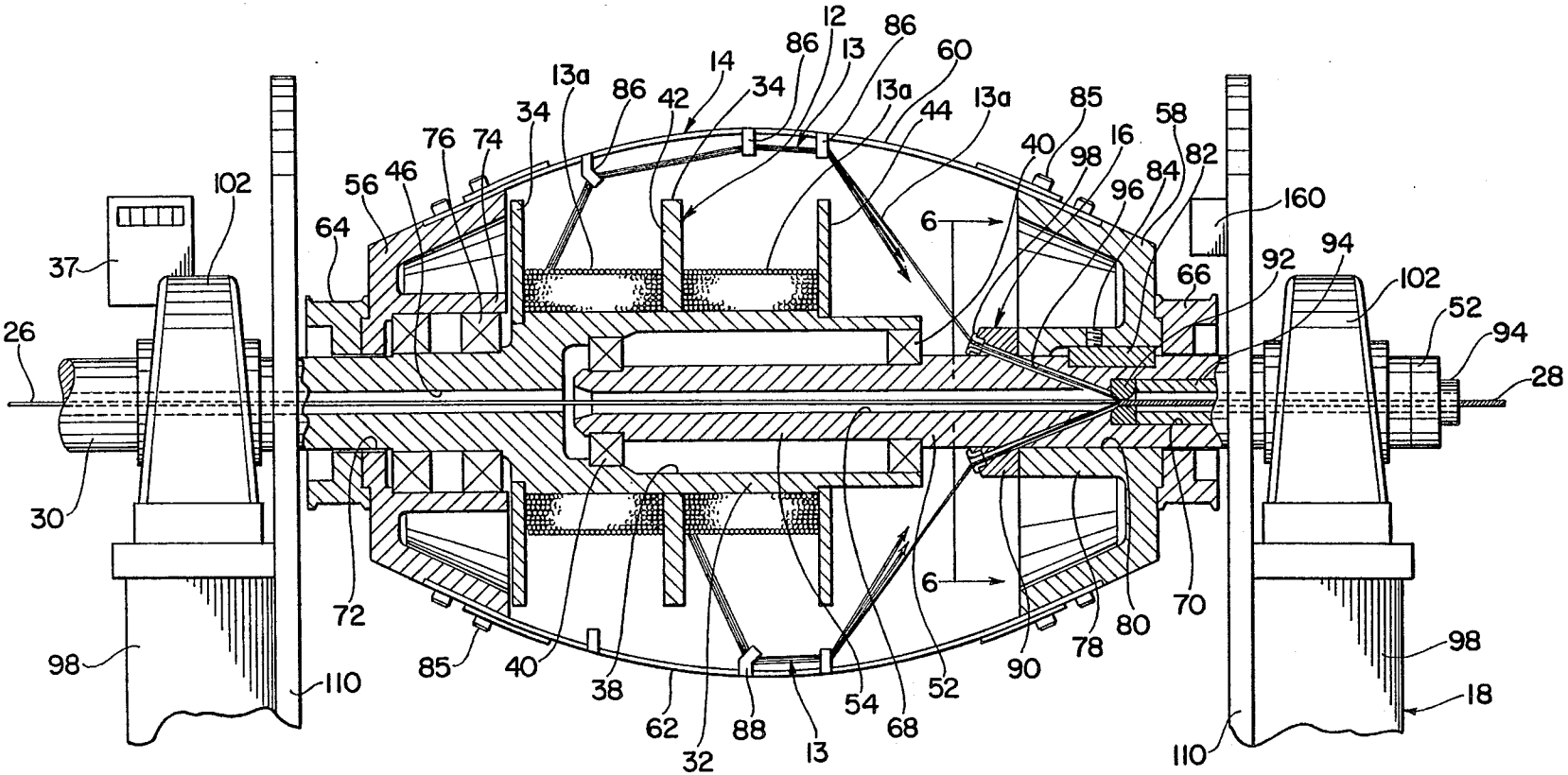
FIG. 4 is a sectional view of the wire twisting portion of the apparatus.

Referring now to the drawings, the apparatus of the instant invention is illustrated and generally indicated at 10 in FIGS. 1 through 3. The apparatus 10 comprises a reel assembly generally indicated at 12 having a plurality of groups 13 of wire elements **13*a* wound thereon, a flyer assembly generally indicated at 14, a wire element gathering assembly generally indicated at 16, a frame assembly generally indicated at 18, a drive assembly generally indicated at 20, a cable take-up assembly generally indicated at 22, and a control assembly generally indicated at 24. The reel assembly 12 is mounted in the apparatus 10 for rotation about an axis, and the flyer assembly 14 is mounted for rotation about the same axis so that it travels around the reel assembly 12. The reel assembly 12 and the flyer assembly 14 are supported on the frame assembly 18, and the drive assembly 16 is operative for independently rotating the reel assembly 12 and the flyer assembly 14 about the axis of the reel assembly 12. The gathering assembly 20 is also supported by the frame assembly 18, and it is mounted for rotation with the flyer assembly 14 about the axis of the reel assembly 12. Normally, during operation of the apparatus 10, a core wire 26 is advanced axially through the reel assembly 12, the flyer assembly 14 and the gathering assembly 20, and the wire elements 13***a* are unwound from the reel assembly 12 with the flyer assembly 14. As the wire elements 13*a* are unwound by the flyer assembly 14, they are passed to the gathering assembly 20 where they are twisted or wound around the core element 26 to produce a stranded cable 28. It is, however, also possible to operate the apparatus 10 without a core element 26 so that the wire elements 13*a* are twisted together to form a cable without a central core element. In any event, the take-up assembly 22 operates to draw the finished cable 28 from the gathering assembly 20, and the control assembly 24 measures the number of rotations of the flyer assembly 14 per unit length of the cable 28, and it adjusts the rotational speed of the flyer assembly 14 relative to the rotational speed of the reel assembly 12 to achieve a substantially uniform rate of rotation of the flyer assembly 14 per unit length of the cable 28 so that the cable 28 has a substantially uniform lay length or length of twist throughout its extent.

The reel assembly 12 and the flyer assembly 14 are most clearly illustrated in FIGS. 1, 3, 4 and 5. The reel assembly 12 comprises a main shaft 30 having an enlarged socket portion 32 at the inner end thereof, a plurality of partitions 34 which extend substantially radially outwardly from the socket portion 32, an emergency brake assembly generally indicated at 35, a drive pulley 36, and a sensor 37. The socket portion 32 is formed at the inner end of the shaft 30, and it has an elongated axially extending socket 38 therein containing bearings 40. The partitions 34 extend outwardly in spaced relation from the socket portion 32 to define adjacent first and second reel sections 42 and 44 therein which are coaxially oriented with respect to the shaft 30 and which each have a group 13 of wire elements 13*a* wound thereon. A reduced axial bore 46 extends longitudinally through the shaft 30 from the outer end thereof to the socket 38. The emergency brake assembly 35 is of conventional construction, and it comprises a rotor 48 which is mounted at an intermediate point on the shaft 30 and a caliper assembly 50 which is mounted on the frame assembly 18 and which is operable for applying clamping pressure to the rotor 48 to reduce the rotational speed of and/or stop the reel assembly 12. The drive pulley 36 is also mounted at an intermediate point on the shaft 30, and it is operative for communicating rotation to the reel assembly 12 from the drive assembly 16. The counter 37 is mounted on the frame assembly 18 adjacent the rotor 48, and it preferably comprises a magnetic sensor which senses each revolution of the rotor 48 and a reversible digital counter for counting the number of revolutions sensed by the magnetic sensor. The counter 37 is also connected to the control assembly 24 through wires (not shown) for receiving a signal therefrom which is indicative of the number of revolutions of the flyer assembly 14. Further, the counter 37 is operative for providing an indication of the difference between the number of revolutions of the flyer assembly 14 and the number of revolutions of the reel assembly 12 so that the amount of wire element 13*a* which has been unwound from the reel assembly 14 can be determined.

The flyer assembly 14 comprises a main flyer shaft 52 having an elongated reduced inner end portion 54, first and second flyer end bells 56 and 58, respectively, first and second flyer frames 60 and 62, respectively, and first and second flyer drive pulleys 64 and 66, respectively. The reduced inner end portion 54 is received in the socket 38 of the reel shaft 30 so that it is rotatable in the bearings 40 and so that it is coaxially aligned with the shaft 30. An axial bore 68 extends through the reduced inner end portion 54 and a distance outwardly therebeyond in the shaft 52, and a somewhat larger axial bore 70 which communicates with the axial bore 68 is formed in the outer end portion of the shaft 52. The first end bell 56 is of generally dish-shaped configuration, although it has an axial bore 72 in the end thereof and a circular collar 74 which extends inwardly into the bell 56 from the end thereof. Contained in the collar 74 is a pair of bearings 76 which mount the bell 56 on the shaft 30 adjacent the first reel section 44 so that it is freely rotatable on the shaft 30. The second bell 58 is also of generally dish-shaped configuration, and it has a collar 78 which extends inwardly from the end thereof and an axial bore 80 in the collar 78. The second bell 58 is received on the shaft 52, and it is nonrotatably secured thereto with a key 82 and a set screw 84. Accordingly, the end bells 56 and 58 are assembled in the apparatus 10 so that they generally face each other from opposite sides of the reels 42 and 44. The flyer frames 60 and 62 extend between the end bells 56 and 58 in substantially opposite radial positions with respect to the axis of the shafts 30 and 52, and they are secured to the end bells 56 and 58 with screws 85. Included on the inwardly facing side of the first frame 60 are eyelets 86 which are positioned for receiving the groups 13 of wire elements 13*a* from the first reel portion 42 and for guiding the wire elements 13*a* to points adjacent the inner end of the collar 78. Similarly, eyelets 88 are provided on the inwardly facing side of the second flyer frame 62, the eyelets 88 being positioned for receiving the group 13 of wire elements 13*a* from the second reel section 44 and for guiding the wire elements 13*a* to points adjacent the inner end of the collar 78. The first drive pulley 64 is rotatably received on the shaft 30 and secured to the outer side of the first end bell 56, whereas the second drive pulley 66 is secured to the outer side of the second end bell 58. In this regard, the assembly 14 includes the two pulleys 64 and 66 rather than a single drive pulley due to the relatively light construction of the flyer assembly 14, but in any event, the two pulleys 64 and 66 and the remainder of the flyer assembly 14 rotate with the shaft 52 during operation of the apparatus 10.

The gathering assembly 16 is illustrated most clearly in FIGS. 1 and 4 through 6, and it comprises a lay plate 90, a closing die 92, and a guide tube 94. The lay plate 90 is received and nonrotatably secured on the shaft 50 adjacent the inner end of the collar 78, and a plurality of bores 96 are formed in the lay plate 90 and the adjacent portions of the shaft 52 so that the bores 96 extend angularly inwardly in spaced converging relation toward the axis of the shaft 52 to the enlarged bore 70. Rounded eyelets 98 are received in the outer ends of the bores 96, and the closing die 92 is positioned adjacent the inner end of the bore 70 proximal the inner ends of the bores 96. The tubular element 94 is received in the bore 70 so that it extends from the closing die 92 to the outer end of the shaft 52. Accordingly, during operation of the apparatus 10, the wire elements 13*a* are passed from the first and second frames 60 and 62, respectively, to the lay plate 90 where each of the wire elements 13*a* is received in a different aperture 96. The wire elements 13*a* are passed through the apertures 96 and twisted onto the core 26 by the closing die 92 as the flyer assembly 14 and the gathering assembly 16 are rotated together about the core wire 26. The stranded cable 28 which is produced as the wire elements 13*a* are twisted onto the core 26 travels through the tubular element 94 to the end of the shaft 52 and then onto the control assembly 24 and the take-up assembly 22.

The frame assembly 18 is illustrated most clearly in FIGS. 1 and 2, and it comprises a base 97, three main supports 98 which extend upwardly from the base 97, a secondary support plate 99 which also extends upwardly from the base 97, and a drive motor table 100. The three supports 98 have pillow blocks 102 mounted on the upper ends thereof for rotatably supporting and positioning the shafts 30 and 52 in coaxial relation. The table 100 is disposed rearwardly of the supports 98, and it comprises a pair of spaced side walls 102 and a top wall 104. The caliper assembly 50 is mounted on the top wall 104 so that it is engageable with the rotor 48 in the manner hereinabove set forth. Also included in the frame assembly 18 is a shelf 106 which is attached to the right-hand support 98 for supporting a portion of the take-up assembly 22 as will hereinafter be more fully set forth. The frame assembly 18 further includes end guards 110 which are attached to the center and right-hand supports 98 so that they extend upwardly from the base 97 and pass adjacent the outboard sides of the pulleys 64 and 66 for providing end guards for the reel assembly 12 and the flyer assembly 14.

The drive assembly 20 comprises a reversible main drive motor 112 which is mounted on the top wall 104 of the table 100 and which communicates with the reel assembly drive pulley 36 through a pulley 114 and a belt 116. The drive assembly 20 further comprises a front intermediate shaft generally indicated at 118 comprising a pair of shaft portions 119 which are normally operatively connected by a clutch 120. Intermediate shaft drive pulleys 121 and 122 are mounted on the main and front intermediate shafts 30 and 118, respectively, and a belt 123 extends therebetween for driving the front intermediate shaft 118. A rear intermediate shaft 124 is rotatably mounted in the side walls 102 of the table 100, and a conventional variable diameter pulley assembly 126 having a variable diameter pulley 128 and a control 130 is mounted on the shaft 124 so that the pulley 128 rotates therewith but so that the variable diameter pulley assembly 126 is also supported by the secondary support plate 99. The rear intermediate shaft 124 has a pulley 132 mounted thereon, and a belt 134 extends between the pulley 132 and the variable diameter pulley 128 for driving the shaft 124. Accordingly, the rotational speed of the rear intermediate shaft 124 is adjustable by operating the control 130 to vary the diameter of the variable diameter pulley 128. The rear intermediate shaft 124 has a pair of pulleys 134 mounted thereon which are connected to the flyer drive pulleys 64 and 66 through belts 138 for driving the flyer assembly 14. Hence, the drive motor 112 is directly connected to the shaft 30 through the belt 116 so that the reel assembly 12 normally rotates at a fixed rate, whereas the flyer assembly 14 is indirectly connected to the drive motor 112 through the variable diameter pulley assembly 126 so that the rotational speed of the flyer assembly 14 is adjustable relative to the rotational speed of the reel assembly 12. The drive motor 112 is preferably reversible for rewinding additional groups 13 of wire elements 13*a* onto the reel assembly 12.

The take-up assembly 22 comprises a take-up reel drive motor 140, a take-up reel 142, and a traverse assembly 144. The take-up reel drive motor 140 is mounted on the base plate 97, and the take-up reel 142 is mounted about a substantially horizontal axis on a shaft 145 which is secured in support bushings 146 on the right-hand vertical support 98. The shaft 145 is connected to the take-up reel drive motor 140 through a pulley and belt assembly 148. The take-up reel 142 is positioned beneath the control assembly 24 in order to receive stranded cable 28 therefrom, and the take-up motor 140 is preferably constructed so that it is adjustable to apply preset amounts of tension to the cable 28. The traverse assembly 144 is of conventional construction, and it is secured to the right-hand support 98 so that it extends over the take-up reel 142. The traverse assembly 144 includes a traverse element 150 through which the cable 28 passes and a shaft 152 on which the traverse element 150 is mounted. The shaft 152 is supported by a pillow block 154 which is mounted on the shelf 108, and the shaft 152 is driven by a chain and sprocket assembly 156 which is driven by the front intermediate shaft 118. The traverse assembly 144 is constructed so that when the shaft 152 is rotated, the traverse element 150 travels back and forth thereon to evenly distribute the cable 28 on the reel 142 as the reel 142 is rotated.

The control assembly 24 preferably comprises a conventional control assembly, such as a "Cook Acculay Digital Lay Control System" of the type manufactured by the Cook Machinery Division of the Entwistle Company, Hudson, Mass. In this connection, although heretofore systems of this type have only been utilized in combination with conventional wire twisting machines of the type wherein wire is twisted before it is passed through a flyer and onto a reel, it has been found that the "Cook Acculay Digital Lay Control System" can be effectively utilized in the apparatus of the instant invention when connected in the manner herein set forth. In any event, the control assembly 24 as herein embodied comprises a pair of cable rollers 158, a roller revolution sensor 159, a flyer revolution sensor 160, and a comparator/controller 162. The sensors 159 and 160 preferably comprise conventional magnetic revolution sensors, and they are operative for sensing complete revolutions of the rollers 158 and the end bell 58, respectively. Further, since the number of revolutions made by the rollers 158 per unit of time is actually proportioned to the length of the cable 28 which is produced during the same time period, the sensor 159 actually provides an indication of the rate at which the cable 28 is produced. The comparator/controller 162 receives signals from the sensors 159 and 160, and it is operative for determining the rate of rotation of the flyer assembly 14 per unit length of cable 28, and this value corresponds directly to the length of each twist in the cable 28. The comparator/controller 162 is operatively connected to the control 130 on the variable diameter pulley assembly 126 through wires (not shown), and it is operative for adjusting the diameter of the pulley 128 to change the rotational speed of the flyer assembly 14 and to thereby achieve a substantially uniform length of twist throughout the extent of the cable 28. It will be understood, however, that other embodiments of the apparatus of the instant invention wherein the rotational speed of the reel assembly 12 or the rotational speeds of both the reel assembly 12 and the flyer assembly 14 are controlled to achieve a uniform length of twist in the cable 28 are contemplated.

Accordingly, for use and operation of the apparatus 10 in accordance with the method of the instant invention, groups 13 of the wire elements 13*a* are first wound on the first and second reel sections 42 and 44, respectively. In this connection, the wire elements 13*a* preferably comprise single metal filaments or wires having diameters of between 0.002" and 0.050", depending on the requirements for the cable 28 which is to be produced and the overall capacity of the apparatus 10. The wire elements 13*a* may alternatively comprise twisted or untwisted groups of filaments or wires, but in any case they are wound on the reel sections 42 and 44 in groups 13 of side-by-side wire elements 13*a*, and the reel sections 42 and 44 are preferably each supplied with substantially the same amount of the wire elements 13*a*. Further, the group 13 which is wound on the first reel section 42 preferably contains the same number of wire elements 13*a* as the group 13 which is wound on the second reel section 44, and all of the wire elements 13*a* are preferably of substantially the same diameter. Still further, the groups 13 are preferably simultaneously wound on their respective reel sections 42 and 44, and the number of revolutions of the shaft 30 is preferably counted with the counter 37 as the groups 13 are wound on the reel sections 42 and 44. During operation of the apparatus 10, the groups 13 of wire elements 13*a* extend through their respective eyelets 86 and 88, and then the individual wire elements 13*a* in the groups 13 are separated so that they pass through different eyelets 98 and bores 96 in the lay plate 90 and the shaft 52. When the apparatus 10 is utilized for producing a cable having a central core, a core wire 26 which preferably comprises a metal filament or wire element of the same dimension as the wire elements 13*a* extends through the axial bore 46, through the bore 68 and into the closing die 92 where the wire elements 13*a* are twisted thereon to form the cable 28. The cable 28 then passes through the tubular element 94, around the rollers 158, through the traverse element 150 and onto the reel 142. The reel assembly 12 and the flyer assembly 14 are rotated by the main drive motor 112, and the take-up reel 142 is powered by the take-up reel motor 140. It should be pointed out that it is important that the flyer assembly 14 be rotated at a speed which is sufficient to unwind the groups 13 of wire elements 13*a* from the reel sections 42 and 44 so that the wire elements 13*a* and the core 26 are drawn through the closing die 92 where the wire elements 13*a* are twisted around the core 26 as the gathering assembly 20 rotates with the flyer assembly 14. In this connection, depending on the direction in which the wire elements 13*a* are wound on the reel sections 42 and 44, the rotational speed of the flyer assembly 14 must be either greater than or less than the rotational speed of the reel assembly 12 in order to unwind the wire elements 13*a*. Thereafter, in any event, by adjusting the rotational speed of the flyer assembly 14 relative to the rotational speed of the reel assembly 12, the length of twist or lay length of the wire elements 13*a* around the core element 26 can be adjusted. More specifically, by adjusting the rotational speed of the flyer assembly 14 relative to the rotational speed of the reel assembly 12 so that the wire elements 13*a* are unwound from the reel sections 42 and 44 at an increased rate, the lay length, i.e., the length of twist in the cable 28 is increased; and conversely, by adjusting the speed of the flyer assembly 14 so that the wire elements 13 are unwound at a slower rate, the length of twist in the cable 28 is decreased. However, it will be appreciated that as the wire elements 13*a* are unwound from the reel sections 42 and 44, the wound diameters of the wire elements 13*a* on the reel sections 42 and 44 gradually decrease, and therefore the rate at which the wire elements 13*a* are unwound would also be decreased if the rotational speed of the flyer assembly 14 relative to the rotational speed of the reel assembly 12 were to remain constant. However, since the control assembly 24 is operative for controlling and adjusting the rotational speed of the flyer assembly 14 so that the flyer assembly 14 rotates at a constant rate relative to the unit length of the cable 28 which is produced from the apparatus 10, it is possible to maintain the length of twist in the cable 28 at a substantially uniform value.

It has been found that as the cable 28 is produced from the apparatus 10, some of the wire elements 13*a* are inherently wound less tightly than others by the closing die 92 and that this can detract from the overall quality of the cable 28. However, by applying a constant tension to the cable 28 with the take-up assembly 22, it is possible to stretch some of the tighter wire elements 13 so that all of the wire elements 13 are relatively tight in the finished cable 28. Accordingly, by applying a uniform tension to the cable 28 with the take-up assembly 22, and by properly adjusting the motor 140 so that it maintains the desired amount of tension in the cable 28, the overall quality of the cable 28 can be enhanced. However, since rates of rotation of the reel assembly 12 and the flyer assembly 14 control the rate of production of the cable 28, the tension which is applied to the cable 28 does not change the rate at which the cable 28 is produced.

In order to make a cable 28 of increased length, the number of revolutions of the reel assembly 12 and the flyer assembly 14 about the axis of the shaft 30 are preferably counted on the counter 37 as the wire elements 13*a* are unwound so that the apparatus 10 can be shut off just before the wire elements 13*a* are completely unwound. It is then possible to manually unwind the remaining wire elements 13*a* from the reel sections 42 and 44 and to wind new groups 13 of wire elements 13*a* on the reel sections 42 and 44. When the reel sections 42 and 44 are filled with the new wire elements 13*a*, the original wire elements 13*a* from each the reel sections 42 and 44 can be individually welded to new wire elements 13*a* on the same reel sections 42 and 44, respectively, so that the welds in each group 13 are staggered at different longitudinal positions therein. Thereafter, the apparatus 10 can be operated in the manner hereinabove set forth, and a new section of cable 28 which is effectively connected to the original section of cable 28 can be produced.

It is seen, therefore, that the instant invention provides a highly effective apparatus and method for making stranded cable. The apparatus 10 can be effectively utilized for making unlimited lengths of stranded cable having substantially uniform lengths of twist. Further, since the reel assembly 12 and the flyer assembly 14 are permanently assembled in the apparatus 10, they can be effectively operated at high rates of rotation without failure and/or excessive amounts of vibration. Hence it is seen that the apparatus of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for twisting a filament on an advancing core to form a cable comprising:

a. a reel mounted for rotation about an axis and having a filament wound thereon;

b. a flyer mounted for rotation about said axis so that it travels around said reel, said flyer engaging said filament and being operable for unwinding it from said reel;

c. means for rotating said reel about said axis;

d. means for rotating said flyer about said axis in the same direction as said reel and at a speed which causes said filament to be unwound from said reel;

e. gathering means mounted for rotation about said axis with said flyer, said core passing axially through said gathering means, said filament passing to said gathering means from said flyer, said gathering means twisting said filament around said core element to form said cable;

f. means for drawing said cable from said gathering means; and g. means for controlling and adjusting the rotational speed of said flyer relative to the rotational speed of said reel to achieve a substantially uniform number of rotations of said flyer per unit length of said cable.

2. In the apparatus of claim 1, said reel further characterized as a first reel and having a first filament wound thereon, said apparatus further comprising a second reel mounted for rotation about said axis with said first reel by said reel rotating means and having a second filament wound thereon, said first and second reels being of substantially the same dimension and having substantially the same quantities of filaments wound thereon, said flyer comprising first and second flyer portions mounted for rotation about said axis, said flyer rotating means rotating said first and second flyer portions so that they travel around said first and second reels, respectively, said first and second flyer portions engaging said first and second filaments, respectively, and being operable for unwinding them from said first and second reels, respectively, said filaments passing from their respective flyer portions to said gathering means, said gathering means aligning said filaments in different spaced positions around said core and twisting said filaments to form said cable.

3. The apparatus of claim 1 further comprising means for determining the number of revolutions of said flyer relative to said reel.

4. In the apparatus of claim 1, said gathering means comprising a closing die.

5. An apparatus for twisting a plurality of filaments on an advancing core to form a cable comprising:

a. a reel mounted for rotation about an axis and having a group of side-by-side filaments wound thereon;

b. a flyer mounted for rotation about said axis so that it travels around said reel, said flyer engaging said group of filaments and being operable for unwinding said group from said reel;

c. means for rotating said reel about said axis;

d. means for rotating said flyer about said axis in the same direction as said reel and at a speed which causes said group to be unwound from said reel by said flyer;

e. gathering means rotating with said flyer about said axis, said core passing axially through said gathering means, said filaments passing to said gathering means from said flyer, said gathering means aligning different filaments of said group in different spaced positions around said core and twisting said filaments around said core to form said cable;

f. means for drawing said cable from said gathering means; and g. means for controlling and adjusting the rotational speed of said flyer relative to the rotational speed of said reel to achieve a substantially uniform number of rotations of said flyer per unit length of said cable.

6. In the apparatus of claim 5, said drawing means applying controlled tension to said cable to tighten the filaments therein.

7. In the apparatus of claim 6, said flyer rotating means and said reel rotating means being independent of said cable drawing means, said cable drawing means drawing said cable without significantly affecting the rotational speeds of said flyer and said reel.

8. In the apparatus of claim 5, said reel further characterized as a first reel and having a first group of filaments wound thereon, said apparatus further comprising a second reel mounted for rotation about said axis with said first reel and having a second group of side-by-side filaments wound thereon, said first and second groups comprising substantially the same number of filaments, said first and second reels being of substantially the same dimension and having substantially the same quantities of filaments wound thereon, said flyer comprising first and second flyer portions mounted for rotation about said axis, said flyer rotating means rotating said first and second flyer portions so that they travel around said first and second reels, respectively, said first and second flyer portions engaging said first and second groups of filaments, respectively, and being operable for unwinding them from said first and second reels, respectively, said filaments passing from their respective flyer portions to said gathering means, said gathering means aligning said filaments in different spaced positions around said core and twisting said filaments around said core to form said cable.

9. In the apparatus of claim 8, said first and second reels being connected and being permanently mounted in said apparatus, said core passing axially through said first and second reels.

10. In the apparatus of claim 8, said first and second flyer portions being disposed in substantially equally spaced radial positions relative to said axis, said gathering means aligning said filaments from said first group in spaced relation on the same side of said axis as said first flyer portion and aligning said filaments from said second group in spaced relation on the same side of said axis as said second flyer portion.

11. In the apparatus of claim 8, said flyer rotating means and said reel rotating means being independent of said cable drawing means, said cable drawing means drawing said cable without significantly affecting the rotational speeds of said flyer and said reel.

12. An apparatus for twisting a plurality of filaments to form a cable comprising:

a. a reel mounted for rotation about an axis and having a group of side-by-side filaments wound thereon;
b. a flyer mounted for rotation about said axis so that it travels around said reel, said flyer engaging said group of filaments and being operable for unwinding said group from said reel;
c. means for rotating said reel about said axis;
d. means for rotating said flyer about said axis in the same direction as said reel and at a speed which causes said group to be unwound from said reel by said flyer;
e. gathering means rotating with said flyer about said axis, said filaments passing to said gathering means from said flyer, said gathering means gathering said filaments, aligning different filaments of said group in different radial positions, and twisting said filaments to form said cable;
f. means for drawing said cable from said gathering means; and
g. means for controlling and adjusting the rotational speed of said flyer relative to the rotational speed of said reel to achieve a substantially uniform number of rotations of said flyer per unit length of said cable.

13. An apparatus for twisting a plurality of filaments to form a cable comprising:
a. a first reel mounted for rotation about an axis and having a first filament wound thereon;
b. a second reel mounted for rotation about said axis and having a second filament wound thereon;
c. a flyer mounted for rotation about said axis, said flyer comprising first and second flyer sections which are mounted for rotation about said first and second reels, respectively, and being operable for unwinding said first and second filaments therefrom, respectively;
d. means for rotating said first and second reels together about said axis;
e. means for rotating said flyer about said axis in the same direction as said first and second reels at a speed which causes said first and second filaments to be unwound from said first and second reels, respectively, with said first and second flyer sections, respectively;
f. gathering means rotating with said flyer about said axis, said filaments passing to said gathering means from said flyer sections, said gathering means gathering said first and second filaments, aligning them in different spaced radial positions and twisting said filaments to form said cable;
g. means for drawing said cable from said gathering means; and
h. means for controlling and adjusting the rotational speed of said flyer relative to the rotational speed of said reels to achieve a substantially uniform number of rotations of said flyer per unit length of said cable.

14. A method of forming a cable comprising:
a. winding a first group of filaments onto a reel;
b. unwinding said first group of filaments from said reel with a flyer which rotates around said reel as said reel is rotated and in the same direction as said reel;
c. twisting the unwound filaments from said first group on an advancing core with a rotating closing die to form said cable, said closing die rotating with said flyer;
d. drawing said cable from said closing die; and
e. controlling the rotational speed of said flyer relative to the rotational speed of said reel to achieve a substantially uniform length of twist in said cable.

15. The method of claim 14 further comprising the steps of:
a. winding a second group of filaments onto said reel after said first group of filaments has been unwound therefrom, said second group consisting of the same number of filaments as said first group;
b. individually welding the filaments in said second group to the filaments in said first group so that the different welds between the filaments in said first and second groups are in longitudinally spaced relation;
c. unwinding said second group of filaments from said reel with said flyer;
d. twisting the unwound filaments from said second group on said core with said closing die to form a further length of said cable;
e. drawing said further length of said cable from said closing die; and
f. controlling the rotational speed of said flyer relative to the rotational speed of said reel to achieve a substantially uniform length of twist in said further length of said cable.

16. A method of forming a cable comprising:
a. winding a first group of filaments onto a reel;
b. unwinding said first group of filaments from said reel with a flyer which rotates around said reel as said reel is rotated and in the same direction as said reel;
c. twisting the unwound filaments from said first group with a rotating closing die to form said cable, said closing die rotating with said flyer;
d. drawing said cable from said closing die; and
e. controlling the rotational speed of said flyer relative to the rotational speed of said reel to achieve a substantially uniform length of twist in said cable.

17. The method of claim 16 further comprising the steps of:
a. winding a second group of filaments onto said reel after said first group of filaments has been unwound therefrom, said second group consisting of the same number of filaments as said first group;
b. individually welding the filaments in said second group to the filaments in said first group so that the different welds between the filaments in said first and second groups are in longitudinally spaced relation;
c. unwinding said second group of filaments from said reel with said flyer;
d. twisting the unwound filaments from said second group on said core with said closing die to form a further length of said cable;
e. drawing said further length of said cable from said closing die; and
f. controlling the rotational speed of said flyer relative to the rotational speed of said reel to achieve a substantially uniform length of twist in said further length of said cable.

18. A method of forming a cable comprising:
a. winding a first filament onto a reel;
b. unwinding said first filament from said reel with a flyer which rotates around said reel as said reel is rotated and in the same direction as said reel;

c. twisting the unwound first filament on an advancing core with a rotating closing die to form said cable, said closing die rotating with said flyer;
d. drawing said cable from said closing die; and
e. controlling the rotational speed of said flyer relative to the rotational speed of said reel to achieve a substantially uniform length of twist in said cable.

19. The method of claim 18 further comprising the steps of:
a. winding a second filament onto said reel after said first filament has been unwound therefrom;
b. welding said second filament to said first filament;
c. unwinding said second filament from said reel with said flyer;
d. twisting the unwound second filament on said core with said closing die to form a further length of said cable;
e. drawing said further length of said cable from said closing die; and
f. controlling the rotational speed of said flyer relative to the rotational speed of said reel to achieve a substantially uniform length of twist in said further length of said cable.

20. A method of forming a cable comprising:
a. winding a filament onto a first reel;
b. winding a different filament onto a second reel;
c. unwinding said filaments from said first and second reels with a flyer which rotates around said first and second reels as said first and second reels are rotated together, said flyer rotating in the same direction as said first and second reels;
d. twisting the unwound filaments from said first and second reels with a rotating closing die to form said cable, said closing die rotating with said flyer;
e. drawing said cable from said closing die; and
f. controlling the rotational speed of said flyer relative to the rotational speed of said reels to achieve a substantially uniform length of twist in said cable.

21. The method of claim 20 further comprising the steps of:
a. winding second filaments onto each of said first and second reels;
b. welding said second filaments to said first filaments;
c. unwinding said second filaments from said reels with said flyer;
d. twisting the unwound second filaments with said closing die to form a further length of said cable;
e. drawing said further length of said cable from said closing die;
f. controlling the rotational speed of said flyer relative to the rotational speed of said reel to achieve a substantially uniform length of twist in said further length of said cable.

* * * * *